US008490254B1

(12) United States Patent
Johnston

(10) Patent No.: US 8,490,254 B1
(45) Date of Patent: Jul. 23, 2013

(54) BELT BUCKLE

(76) Inventor: Trevor Jamison Johnston, Walnut Creek, CA (US)

( * ) Notice: Subject to any disclaimer, the term of this patent is extended or adjusted under 35 U.S.C. 154(b) by 443 days.

(21) Appl. No.: 12/800,885

(22) Filed: May 24, 2010

Related U.S. Application Data

(63) Continuation-in-part of application No. 12/004,277, filed on Dec. 19, 2007, now Pat. No. 7,748,088.

(51) Int. Cl.
*A44B 11/22* (2006.01)

(52) U.S. Cl.
USPC ..... 24/163 K

(58) Field of Classification Search
USPC ..... 24/163 K; 224/163; 40/640
See application file for complete search history.

(56) References Cited

U.S. PATENT DOCUMENTS

| | | | | |
|---|---|---|---|---|
| 3,979,800 | A * | 9/1976 | Masuda | 24/191 |
| 4,301,917 | A * | 11/1981 | Ancell | 206/39.5 |
| 4,790,435 | A * | 12/1988 | Trusty | 206/39.5 |
| 5,282,297 | A * | 2/1994 | Angus | 24/163 K |
| 6,182,388 | B1 * | 2/2001 | Patton | 40/640 |
| 7,748,088 | B1 * | 7/2010 | Johnston | 24/163 K |
| 2007/0084892 | A1 * | 4/2007 | Korlath | 224/163 |

FOREIGN PATENT DOCUMENTS

DE 29614240 U1 * 10/1996

* cited by examiner

*Primary Examiner* — James Brittain
(74) *Attorney, Agent, or Firm* — Risto A. Rinne, Jr.

(57) ABSTRACT

An apparatus for securing a pair of trousers about a torso includes a curved planar rear member and a curved planar front member that are disposed in a spaced-apart relationship with respect to each other. A compartment is disposed between the rear member and the front member that is open at one end of the apparatus and covered at the top, bottom, sides, and at an opposite end. The compartment is able to retain one or more credit card sized objects therein. A fastener assembly is attached to an underside of the rear member. The fastener assembly is able to secure both ends of a belt thereto. An inner curved flat spring extends upward from the rear member toward the front member and supplies tension to the object or objects in the compartment, thereby helping to secure the objects therein. The front member includes an exterior perimeter that extends down toward the rear member. The exterior perimeter provides a neat appearance and allows the use of larger-sized versions of the front member with the same sized rear member.

12 Claims, 3 Drawing Sheets

BELT BUCKLE

This application is a related as a continuation-in-part of patent application Ser. No. 12/004,277 that was filed on Dec. 19, 2007, now U.S. Pat. No. 7,748,088 entitled "Belt Buckle", by the same inventor, and it claims the benefit of the date of priority, thereof.

BACKGROUND OF THE INVENTION

1. Field of the Invention

The present invention, in general, relates to belt buckles and, more particularly, to a belt buckle that includes a compartment.

Belt buckles are well known devices used for fastening a belt, such as is used to retain trousers in position.

There has been a long-standing need to carry a valid picture identification, such as a driver's license, and credit card(s) (or debit card(s), etc.) at most times when a person is away from home. The credit or debit cards are used for purchases and the picture identification is used to verify the identity of the person and also that the age of the person is above whatever minimum threshold may be applicable.

There has also been a long-standing need not to lose the picture identification or the credit card. Loss of identification or credit/debit cards can occur as a result of misplacement of a wallet or having it fall out of a pocket, as when sitting in a chair and inclining the hips rearward. Loss can also occur by theft, including theft by pickpockets.

A wallet creates a bulge in the pocket of trousers. The bulge is aesthetically unappealing. Worse yet, it provides a clear and easy signal to any nearby pickpocket of its presence. Pickpockets (those who have skill in removing [i.e., stealing] items out of pockets) find that stealing a wallet out of a pocket is a fairly easy task to accomplish.

While various wallet designs have been provided, there has remained a longstanding need to provide an effective way of carrying proper personal identification and/or credit/debit cards that provides a secure means for retaining the personal identification and credit cards and which is also unobtrusive.

Ideally, a bystander or would-be-pickpocket would not even know that the user was carrying any form of personal identification or any credit/debit cards. Additionally, it would also be preferable if any device that was used to carry the personal identification and/or credit/debit cards was also capable of sufficiently hindering the efforts of any pickpocket who was astute-enough to recognize such a device to the point where the pickpocket would not even attempt to gain access to the contents of the device.

If the device served another function not commonly associated with the transport of personal identification or credit/debit cards that would be better still, as the device would be perceived by the general population as something other than a carrier of one's personal identification and/or credit/debit cards. By serving a dual function, the need for a separate device to carry the personal identification and/or credit/debit cards would also be eliminated. The user of such a device would then have one fewer thing to keep track of, remember to take, not lose, and transport. Also, without the presence of a wallet in their pants the appearance of the user would be improved.

Additionally, similar needs also apply to women as they, too, must be able to present adequate personal identification when required and to use credit and/or debit cards when necessary. As a result women often opt to carry purses or handbags of all sizes and shapes which they are, at times, apt to forget and possibly leave behind. For example when dining at a restaurant, a purse or handbag placed on the floor or on an empty chair can be easily overlooked and left behind.

Also, purses and handbags are notoriously easy targets for pickpockets as well as for a class of thieves whose modus operandi includes their approach toward a woman that has been targeted, the grabbing of her purse or handbag, the application of force to remove it from her possession, and then quickly departing with the woman's purse or handbag. If a woman is carrying a purse or handbag she is subject to the actions of pickpockets or thieves.

Additionally, there are also times when a woman cannot practically attend to her purse or handbag. For example, when she is on the floor dancing at a club it may not be practical for her to be carrying her purse or handbag while she is dancing.

Accordingly, the needs of women would be similarly served by a device as described above.

Belt buckles have been modified to include enlarged rigid compartments into which an item or items, such as a picture identification and credit card may be placed. This permits the person to not have to carry a wallet, which can be left behind in a more secure location such as at home or hidden in a locked automobile.

However, these prior-art types of belt buckles include a thick rigid compartment that makes the belt buckle thick and unappealing. This also alerts pickpockets of its presence.

Additionally, the prior art belt buckles with compartments either include an open top for the compartment that makes access to the picture identification and credit card (or whatever else may be carried therein) easy for a pickpocket to remove. Having a top that can inadvertently open also creates a potential adverse situation whereby gravity can cause these items to fall out of the belt buckle compartment and become lost when the person bends sufficiently far forward for any reason, such as to pick up something of off the floor or reach for item on a surface a couple of feet beyond where they are standing. The person may not even be aware that anything has fallen, especially if there is a sufficient amount of background noise.

Accordingly, there is a longstanding need for a device that is able to positively retain a user's personal identification and/or credit/debit card(s).

Other prior art types of belt buckles that include a compartment require either total or partial removal of the belt from the trousers in order to open the compartment. This is not practical, as it takes excessive time to accomplish and also because the person attempting to access the compartment may appear somewhat odd to those observing his (or her) actions. This can embarrass the user and deter use of such a product.

Accordingly, there is a need to provide a device that can effectively retain a user's personal identification and/or credit/debit card(s) while still providing reasonable and convenient access to the user when removal of the card(s) is warranted. Ideally, removal of any card(s) from the device would require contact with the user's body in such a way, for example by requiring contact with sensitive areas of the body or areas that others do not normally make contact with in public, that any attempt at theft (such as by a pickpocket) would be readily detectable by the user. This would deter such attempts.

Certain prior art types of belt buckles that include a compartment also tend to be especially large and heavy. They are large because the face of the buckle has to hide the compartment and, accordingly, prior art buckles that include any sort of a compartment have been made considerably larger than the size of one's driver's license or credit card.

And additionally, it is not possible to change the face of any of these prior art types of belt buckles with a compartment attached thereto. Each prior art device has a uniquely designed compartment and a matching face plate. This prevents mass production of parts which, in turn, increases price and deters use.

Also, prior art types of belt buckles with compartments tend to be linear, straight devices that provide a linear compartment. However, an ideal shape for a belt buckle is curved so that it matches the general anatomical shape of the wearer.

Additionally, a curved belt buckle is aesthetically more pleasing than is a straight type (i.e., one that is not curved) of a belt buckle.

Furthermore, for any given thickness of belt buckle, with or without a compartment, a straight (linear) belt buckle protrudes further out from a wearer's torso than does a curved belt buckle. This is unattractive and, if a compartment is included, makes the belt buckle stand out as being one of the type that could, perhaps, include a compartment attached thereto.

An especially large linear buckle provides an easy visual queue to a potential pickpocket alerting the pickpocket that the belt buckle is of the type that probably contains a credit card and/or some valuable form of picture identification.

Also, prior art types of belt buckles that include a compartment are generally difficult and expensive to manufacture, and they rely upon unorthodox and sometimes difficult to use fastening mechanisms.

It is desirable to provide an especially thin belt buckle that can also house, at a minimum, a valid picture identification card and, ideally, at least one credit or debit card. It is also desirable to be able to contain more than two cards, if desired. For example, a three card capacity can provide sufficient storage to meet most people's card-carrying needs by providing space for the identification and two credit/debit cards. However, to provide a thin and inconspicuous yet solid and secure device that can hold three cards has been heretobefore unattainable. Similarly, to provide a thin and inconspicuous solid device that can secure four or perhaps even more cards has also been unattainable.

Accordingly, there exists today a need for a belt buckle that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and that are not specifically mentioned herein.

As various embodiments of the instant invention help provide a more elegant solution to the various problems and difficulties as mentioned herein, or which may otherwise exist or occur and are not specifically mentioned herein, and by a showing that a similar benefit is not available by mere reliance upon the teachings of relevant prior art, the instant invention attests to its novelty. Therefore, by helping to provide a more elegant solution to various needs, some of which may be long-standing in nature, the instant invention further attests that the elements thereof, in combination as claimed, cannot be obvious in light of the teachings of the prior art to a person of ordinary creativity.

Clearly, such an apparatus would be especially useful and desirable.

2. Description of Prior Art

Belt buckles are, in general, known. For example, the following patents describe various types of these devices:

U.S. Pat. No. 3,969,836 to DuBois, that issued on Jul. 20, 1976;

U.S. Pat. No. 4,113,157 to Woodbury, that issued on Sep. 12, 1978;

U.S. Pat. No. 4,502,188 to Kohli, that issued on Mar. 5, 1985;

U.S. Pat. No. 5,357,638 to Mayzel, that issued on Oct. 25, 1994; and

U.S. Pat. No. 5,687,890 to Wanner, that issued on Nov. 18, 1997.

Also, a prior art belt buckle that includes a metal compartment at a rear inner surface of the buckle and which includes a front surface (i.e., a face) that resembles a flag with a skull and cross-bones image thereon is available for sale at website www.viciousstyle.com.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a belt buckle that includes a compartment attached thereto.

It is also an important object of the invention to provide a belt buckle that includes a compartment which is rigid.

Another object of the invention is to provide a belt buckle that includes a compartment which is thin.

Another continuing object of the invention is to provide a belt buckle that includes a compartment which includes a curvature that generally conforms to the shape of the human torso at the front of the torso at belt level.

Still another object of the invention is to provide a belt buckle that does not protrude outward from the body when it is worn.

Still yet another object of the invention is to provide a belt buckle that includes a rigid compartment that is curved.

Yet another important object of the invention is to provide a belt buckle that includes a face plate that is curved.

Still yet another important object of the invention is to provide a belt buckle that secures a belt around a torso in a conventional manner.

A first continuing object of the invention is to provide a belt buckle that can accommodate a variety of face plates.

A second continuing object of the invention is to provide a belt buckle that is easy to manufacture.

A third continuing object of the invention is to provide a belt buckle that is economical to manufacture.

A fourth continuing object of the invention is to provide a belt buckle that is easy to fasten and remove.

A fifth continuing object of the invention is to provide a belt buckle that can retain a credit card sized object during use and which permits easy withdrawal of the object when the object is needed.

A sixth continuing object of the invention is to provide a belt buckle that includes a compartment and wherein the appearance of a front of the belt buckle is unaffected by the compartment.

A seventh continuing object of the invention is to provide a belt buckle that includes a compartment and wherein the compartment is not visible when the belt buckle is worn and is viewed from the outside.

An eight continuing object of the invention is to provide a belt buckle that includes a container or compartment for storing a credit card or a picture-identification card or both therein and which allows removal or insertion of the cards in the container while the belt buckle is disposed around a torso and secured in position by a belt that is not unloosed.

A ninth continuing object of the invention is to provide a belt buckle that includes a curved rigid rear member and a curved rigid front member that is attached to the rear member and a curved rigid compartment that is disposed between the rear member and the front member, and wherein the compartment is enclosed on three sides.

A tenth continuing object of the invention is to provide a belt buckle that includes a curved rigid rear member and a generally U-shaped interior perimeter that extends away from the rear member and toward a curved rigid front member that is disposed a predetermined distance away from the rear member, and wherein the interior perimeter includes a pair of opposing interior sides and a rear portion that extends between a rear end of each of the opposing interior sides to form an interior enclosure that is disposed between the front member and the rear member and wherein the interior enclosure includes a width and a length that is slightly larger than a width and a length of a credit card.

An eleventh continuing object of the invention is to provide a belt buckle that includes a curved rigid rear member and a curved rigid front member that is disposed a predetermined distance away from the rear member and wherein the front member includes a generally U-shaped exterior perimeter that extends away from the front member and toward the rear member and wherein the U-shaped exterior perimeter includes a pair of opposing exterior sides and a rear portion that extends between a rear end of each of the opposing exterior sides to form an exterior enclosure, and wherein the exterior enclosure is enclosed on three sides.

A twelfth continuing object of the invention is to provide a belt buckle that includes a curved rigid rear member and a curved rigid front member that is disposed away from the rear member, and wherein the rear member includes a generally U-shaped interior perimeter that extends away from the rear member and toward the front member and wherein the U-shaped interior perimeter includes a pair of opposing interior sides and a rear interior portion that extends between a rear end of each of the opposing interior sides to form an interior enclosure that is bounded on the bottom and on three sides and open at the top, and wherein the interior enclosure includes a width and a length that is slightly larger than a width and a length of a credit card, and wherein the front member includes a generally U-shaped exterior perimeter that extends away from the front member and toward the rear member and wherein the exterior perimeter includes a pair of opposing exterior sides and a rear exterior portion that extends between a rear end of each of the opposing exterior sides to form an exterior enclosure that is bounded on the top and on three sides and open on the bottom, and wherein the interior enclosure extends toward the front member and wherein the exterior enclosure extends toward the rear member and overlaps the interior enclosure, and wherein the exterior enclosure is disposed in a generally parallel planar and spaced-apart orientation with respect to the interior enclosure, and wherein an area that is disposed between the interior enclosure and the exterior enclosure includes fastening means sufficient to secure the front member to the rear member.

A thirteenth continuing object of the invention is to provide a belt buckle that includes a compartment for receiving at least one credit card therein and means for securing the credit card in the compartment.

Briefly, a belt buckle that is constructed in accordance with the principles of the present invention has a front member that is formed of a rigid material. The front member is formed of a planar material that includes a radius, similar to the shape of a portion of a cylinder. The front member forms a face plate of the buckle. If desired, an optional face plate can be attached to the front member. A rear member that is formed of a rigid material is disposed a predetermined distance away from the front member and attached thereto by rivets or screws. The rear member includes a similar shape as that of the front member. The rear member includes a generally U-shaped interior perimeter that extends away from the rear member and toward the front member. The front member includes a generally U-shaped exterior perimeter that extends away from the front member and toward the rear member. The exterior perimeter overlaps the interior perimeter. The front member, rear member, interior perimeter, and exterior perimeter form a compartment that is open at one end, thereof, and which is enclosed on the top and bottom and on the three remaining sides. At least one credit card and/or a picture-identification card, such as a driver's license can be inserted through the open end and into the compartment or removed from the compartment. A spring disposed in the compartment and attached to the rear member secures the credit card and/or identification card in the compartment. A notch is provided at the open end of the rear member for grasping and removing the credit card and/or the identification card from the compartment. A conventional type of a fastener assembly for a belt is attached to the rear member. A first end of the belt is attached to a rear end of the fastener assembly and a second end of the belt engages with a hook, the hook being attached to an opposite front end of the fastener assembly.

DETAILED DESCRIPTION OF THE INVENTION

Figure 1:
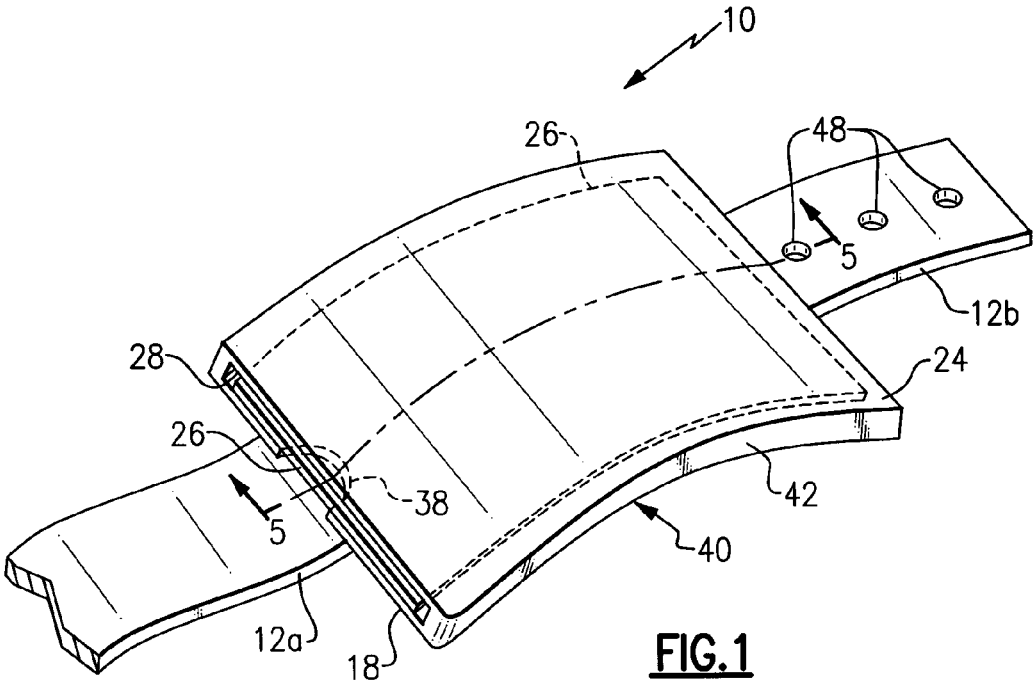
FIG. 1 is a view in perspective of a belt buckle of FIG. 1.

Referring to FIG. 1 and on occasion to all of the drawing figures is shown, a belt buckle, identified in general by the reference numeral 10.

Figure 3:
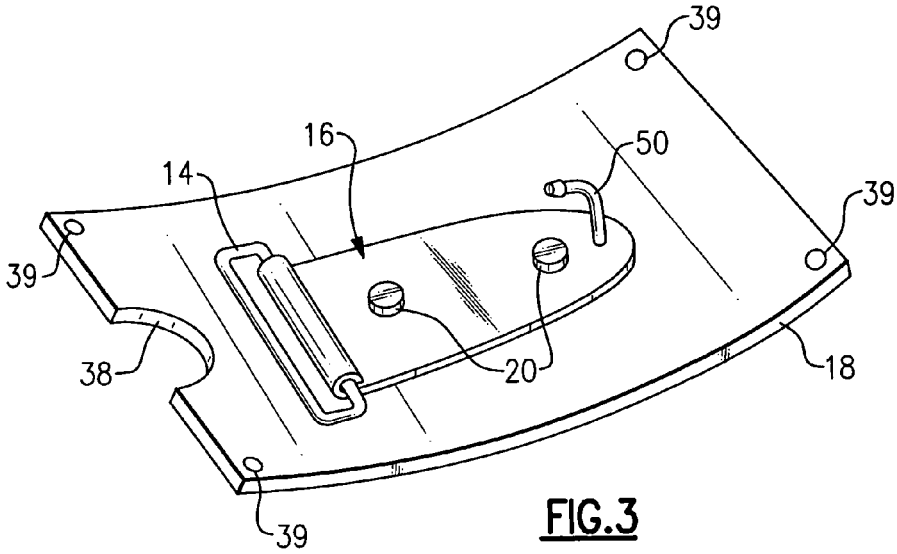
FIG. 3 is a view in perspective of a lower side of the rear member of FIG. 2 without a belt attached thereto.

A loop end of a belt 12*a* is attached to a loop 14 of a fastener assembly, identified in general by the reference numeral 16 (See also FIG. 3). A tip of the loop end of the belt 12*a* wraps around the loop 14 of the fastener assembly 16 and is typically secured to another portion of the loop end of the belt 12 by a snap 13 or other fastener.

The fastener assembly 16 is secured to a bottom of a rear member 18 (See also FIG. 3) by a pair of rivets 20 or by any other preferred type of fastener. The rivets 20 pass through openings in the fastener assembly 16 and through openings provided in the rear member 18.

A curved spring 22 includes opposite spring ends 22*a*, 22*b*. The spring 22 is secured to a top of the rear member 18. It is preferred, but not required, for the curved spring 22 to include spring ends 22*a*, 22*b* that have openings therein that align with the openings of the fastener assembly 16. If they align, the same rivets 20 that secure the fastener assembly 16 to the bottom of the rear member 18 can be used to secure the spring 22 to top of the rear member 18, thereby minimizing the number of fasteners (i.e., rivets 20) that are required. All fasteners (i.e., rivets 20, or screws) are preferably countersunk.

During use, the bottom (surface) of the rear member 18 is disposed adjacent to an upper portion of a pair of pants (i.e., to a torso) of a user of the belt buckle 10.

The spring ends 22*a*, 22*b* may be disposed in a recessed area or in a pair of recessed areas that are provided in the interior or upper surface of the rear member 18. Alternately, if the spring ends 22*a*, 22*b* are sufficiently thin they need not be recessed but can instead be disposed directly on the surface of the rear member 18. The spring 22 extends upward away from the rear member 18 and toward a front member 24 (See also FIG. 4 and FIG. 5) that is disposed a predetermined distance above and away from the rear member 18.

Figure 2:
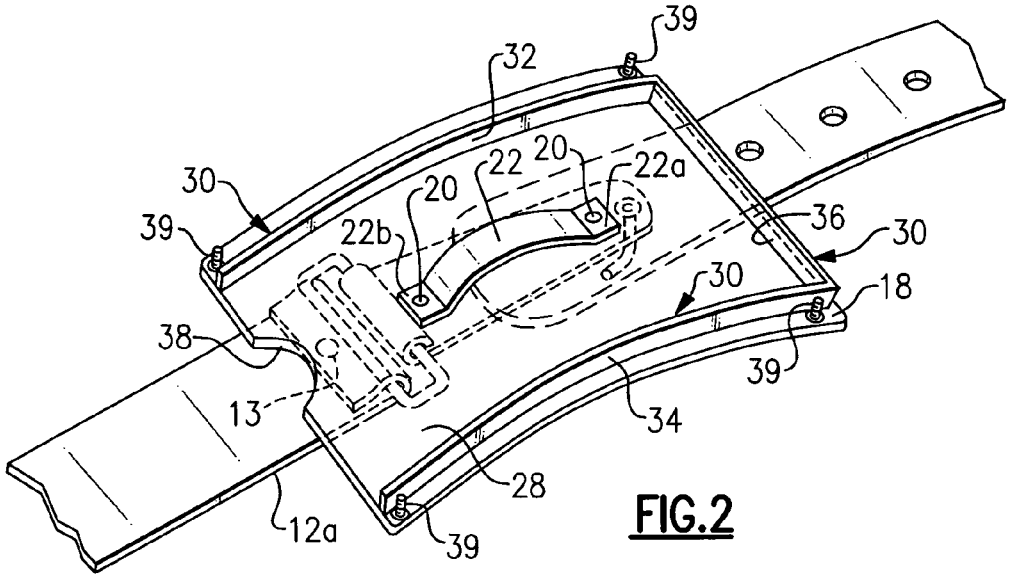
FIG. 2 is a view in perspective of an upper side of a rear member of the belt buckle of FIG. 1.

The spring 22 is flexible and able to compress away from the front member 24 when a card 26 is inserted into a compartment 28 (See also FIG. 2 and FIG. 5) of the belt buckle 10. The card 26 includes a size and shape that is typical for a credit card, debit card, or any desired form of personal identification, such as a driver's license. Ideally, two or more of the cards 26 can fit inside the compartment 28.

The card 26 conforms to the curvature of the front member 24 and the curvature of the rear member 18 when it is inserted into the compartment 28. The forced curvature experienced by the card 26 helps to secure it in the compartment 28 by creating increased friction between the card 26 and the front and rear members 24, 18. The spring 22 supplies a slight additional force that further helps to secure and retain the card 26 in position in the compartment 28.

Both the rear member 18 and the front member 24 are formed of a sufficiently rigid material, such as a metal, to maintain a curved planar shape, similar to the shape of a segment taken off of a hollow cylindrically-shaped object. The rear member 18 and the front member 24 have a similar radius which is designed to conform, generally, to the average curvature of a front of a human torso at a location on the torso where a belt would normally be worn. Accordingly, the rear member 18 and the front member 24 conform to the shape of the torso which ensures that the belt buckle 10 will conform to the shape of the torso and thereby fit snugly against the torso.

The compartment 28 is provided by an enclosed area that is disposed between the front member 24 and the rear member 18. Referring again to FIG. 2, the rear member 18 includes a generally U-shaped interior perimeter attached thereto, identified in general by the reference numeral 30. The interior perimeter 30 extends away from the rear member 18 and toward the front member 24. The interior perimeter 30 includes a pair of parallel opposing interior sides 32, 34 that are spaced apart from each other an amount that is slightly greater than the width of the card 26. The length of the interior sides 32, 34 is slightly greater than the length of the card 26.

A rear interior member 36 (or interior portion) extends between a rear end of each of the opposing interior sides 32, 34. The height of the interior sides 32, 34 and of the rear interior member 36 is sufficient to accommodate the desired number of the cards 26 that the belt buckle 10 is to contain.

The interior sides 32, 34, interior member 36, and rear member 18 combine to form an interior enclosure that is bounded on the bottom by the rear member 18 and on three sides by the interior sides 32, 34 and the interior member 36. Were it not for the front member 24 the interior enclosure would be open at the top. However, the front member 24 is disposed adjacent to an upper surface of the interior sides 32, 34 and an upper surface of the interior member 36. Accordingly, the front member 24 provides an upper, or top, enclosure for the interior enclosure which, thereby, forms the compartment 28. Because the interior enclosure is open at the end of the belt buckle 10 where the loop end of the belt 12*a* is generally disposed, the compartment 28 is also open at that end.

The rear member 18 includes a U-shaped notch 38 area where material has been removed to permit a user to grasp an end of the card 26 (or cards 26) for removal of the card 26 from the compartment 28. The rear member 18 includes four corner fasteners 39 that extend upward and toward the front member 24. The corner fasteners 39 can include rivets or machine screws or any other desired type of fastener. The corner fasteners 39 engage with openings provided in four corner areas 39*a* that are attached to the inside of the front member 24. If the corner fasteners 39 include machine screws the four corner areas 39*a* would include threaded openings that are able to cooperate with the machine screw type of corner fasteners 39. If the corner fasteners 39 include rivets the four corner areas 39*a* would include appropriately sized and shaped openings that are able to cooperate with the rivet type of corner fasteners 39.

Figure 4:
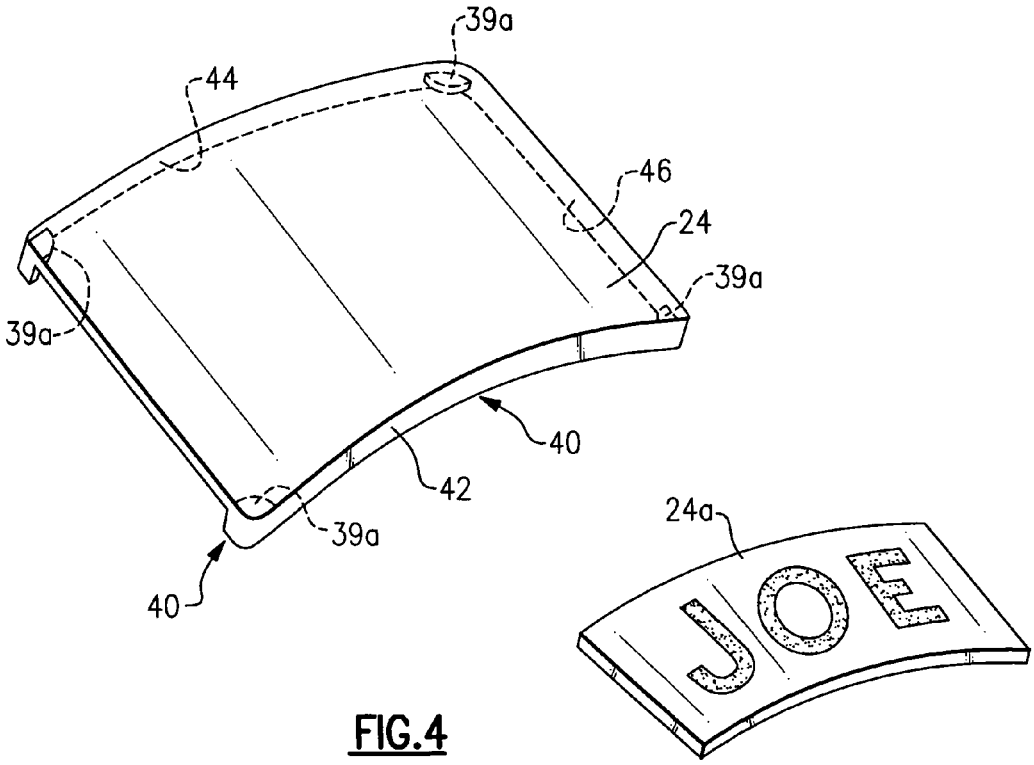
FIG. 4 is a view in perspective of an upper side of a front member of the belt buckle of FIG. 1.

The front member 24 includes a generally U-shaped exterior perimeter attached thereto, identified in general by the reference numeral 40 (See FIG. 1 and FIG. 4). The exterior perimeter 40 extends away from the front member 24 and toward the rear member 18. The exterior perimeter 40 includes a pair of parallel opposing exterior sides 42, 44 that are spaced apart from each other an amount that is generally equal to the maximum width of the belt buckle 10 and which is greater than the spacing between the interior sides 32, 34. The length of the exterior sides 42, 44 is generally equal to the maximum length of the belt buckle 10 and is greater than the length of interior sides 32, 34.

A rear exterior member 46 (or exterior portion) extends between a rear end of each of the opposing exterior sides 42, 44. The height of the exterior sides 42, 44 and of the rear exterior member 46 is sufficient to extend down toward the rear member 18 a desired amount.

For some versions of the belt buckle 10 the height of the exterior sides 42, 44 and of the rear exterior member 46 will be enough to reach and abut the upper surface of the rear member 18. For other versions of the belt buckle 10 the width, length, and height of the exterior sides 42, 44 and of the rear exterior member 46 will be increased enough to overlap the outer perimeter of the rear member 18. This provides a smooth finished appearance for the belt buckle 10. It also allows the use of larger versions (i.e., designs) of the front member 24 with the same rear member 18. This permits mass production of the rear member 18 and the use of all preferred versions of the front member 24 with the same rear member 18.

Certain users of the belt buckle 10 may prefer a larger appearance than other users. Accordingly, custom designed versions of the front member 24 will permit such variation. It is to be understood that the front member 24 can be customized in size and appearance as desired. For example, gold or other inlays as well as precious stones or gems can also be included in the front member 24. If desired, the front member 24 can include the engraving of names or other ornamental designs.

Because the exterior perimeter 40 is larger than the interior perimeter 30, the exterior perimeter 40 covers the interior perimeter 30 and the corner fasteners 39. Accordingly, the interior perimeter 30 and the corner fasteners 39 are not generally visible when the belt buckle 10 is viewed by other people. Also, because the front member 24 is continuous (i.e., it does not include an upper notch) over the notch 38, the notch 38 cannot be seen by the other people.

Therefore, those viewing the belt buckle 10 on the user (i.e., on the person who is wearing it) would not know that the belt buckle 10 was also capable of containing the card(s) 26, therein. To the viewer it would look like a thin and especially attractive version of a buckle for securing a belt, and the viewer would be unaware of its unexpected benefits.

If desired, the exterior perimeter 40 can be extended to provide a slight overlap around the side of the belt buckle 10 where the loop end of the belt 12*a* is disposed, as shown in FIG. 1 and FIG. 4. This provides an even neater appearance. Of course, the amount of overlap must not interfere with the thin rectangular opening that provides access into the compartment 28.

It is important to note that the opening into the compartment 28 is very thin and that most versions of the front member 24 will extend slightly forward of the opening into the compartment 28. Therefore, the opening into the compartment 28 or the edge of the card(s) 26 disposed at the opening will not be generally visible to other people when the belt buckle 10 is being worn. Yet, the user is able to easily extract the card(s) 26 by urging a finger tip under the opening side of the belt buckle 10 where the loop end of the belt 12*a* is disposed and into the notch 38. This displaces the loop end of the belt 12*a* a slight amount inward toward the torso of the user.

Accordingly, the user is able to engage a lower surface of the lowermost card 26 and urge it out of the compartment 28, when needed. This process can be repeated to extract the upper card(s) 26. Also, some users will learn how to modulate the pressure they apply to the underside of the lowermost card 26 and thereby control whether only the lowermost card 26 will be withdrawn from the compartment 28 or if one or more additional cards 26 will be withdrawn simultaneously with the lowermost card 26.

However, if a pickpocket were to attempt to do so, the user would immediately notice contact in this sensitive area of the body. Knowing this, the pickpocket would be disinclined to attempt to steal the card(s) 26. It is also unlikely that the pickpocket would even know that the belt buckle 10 contained the card(s) 26. Accordingly, the design of the belt buckle 10 provides the unexpected benefit of deterring theft by pickpockets.

For most versions of the belt buckle 10, the exterior of the front member 24 provides an attractive face plate that is seen by others. Different materials that are used for construction or different coatings and finishes applied to the exterior surface of the front member 24 can further alter and affect the appearance of the belt buckle 10. If desired, an additional ornamental front plate 24*a* (FIG. 4) can be attached over the exterior of the front member 24 by an adhesive or by soldering or other fastening means, thereby providing additional versatility to vary the appearance of the belt buckle 10 to suit the individual taste of the user.

To secure an opposite open end of the belt 12*b* to the belt buckle 10, the open end of the belt 12*b* is urged under the belt buckle 10 until a desired one of a plurality of spaced-apart holes 48 aligns with a tip of an inwardly curved hook 50. The desired spaced-apart hole 48 slips over the inwardly curving hook 50 to secure the open end of the belt 12*b* and the belt buckle 10 in position.

Figure 5:
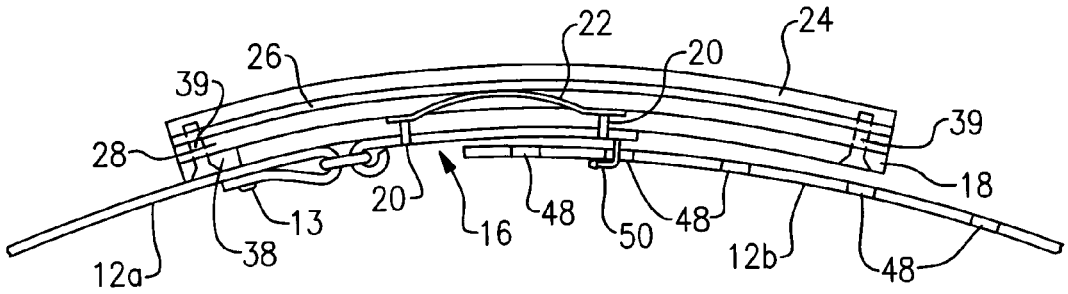
FIG. 5 is a view in cross-section taken along the line 5-5 of FIG. 1.

Ideally, the inwardly curving hook 50 includes an L-shape thereto. The outward force supplied by the torso along with the initial linear shape of the L-shape hook 50 causes the open end of the belt 12*b* (at the desired hole 48 location) to be disposed maximally away from the fastener assembly 16, as shown in FIG. 5. This, in turn, supplies a force that creates a moment arm which tends to urge the opposite end of the belt buckle 10 (i.e., where the notch 38 and the compartment 28 opening are disposed) even closer toward the torso of the user.

By urging the compartment 28 opening tightly against the torso, the compartment 28 opening becomes less noticeable which greatly improves security. Security is further enhanced by urging of the compartment 28 opening end of the belt buckle 10 into the torso as the belt buckle 10 appears thinner and more natural in appearance. This further belies the existence of the compartment 28. Also, any attempt to gain access to the compartment 28 opening would require a pickpocket to exert even greater force, which would make the attempt more likely to be detected.

Also, it is preferable to keep the length and the width as well as the thickness of the rear member 18 as small (or thin) as possible while still providing the compartment 28 with a size that can accept the card(s) 26. This permits the design of the smallest possible version of the belt buckle 10 (in all dimensions). In general, the front member 24 is also made as thin as possible to minimize the overall thickness of the belt buckle 10 (depending also on the number of the cards 26 it is intended to hold). If the smallest possible size for the belt buckle 10 is desired, each of the rear and front member's 18, 24 dimensions are kept as small as possible.

As the rear member 18 is suitable for use with larger versions of the belt buckle 10 that include a larger version of the front member 24, or a larger version of the ornamental front plate 24*a* that is attached to the front member 24, any larger size version of the belt buckle 10 that is desired can also be readily and inexpensively provided.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A belt buckle for use in fastening a belt, comprising:

(a) a front member that includes an exterior surface and an opposite interior surface and which is formed of a substantially rigid material and which includes a curved planar shape, thereto;

(b) a rear member that is formed of a substantially rigid material and which includes a curved planar shape that includes a radius similar to a radius of said front member;

(c) wherein said rear member is attached in a generally parallel spaced-apart manner to said front member;

(d) a compartment that is disposed between said rear member and said front member, wherein said compartment includes a pair of opposite sides and a rear portion that extends between a rear end of each of said pair of opposite sides, and wherein said compartment includes an opening that is disposed at an end of the belt buckle, and wherein said compartment is able to receive at least one credit card, or debit card, or identification card therein;

(e) means for attaching a first end of the belt to the belt buckle and an opposite second end of the belt to the belt buckle, wherein said means for attaching includes a fastener assembly that is attached to a bottom of said rear member by a pair of fasteners that pass through a pair of openings provided in said rear member; and wherein said rear member includes a curved spring attached thereto, and wherein said spring includes opposite spring ends that each include an opening through each of said opposite spring ends, and wherein each of said openings in each of said opposite spring ends aligns with one of said pair of openings provided in said rear member, and wherein each of said opposite spring ends is secured to said rear member by one of said pair of fasteners, and wherein a curved portion of said spring extends away from said rear member and toward said front member, and wherein said spring is flexible and able to compress away from said front member when said credit card, or said debit card, or said identification card is inserted into said compartment, and wherein only said curved portion of said spring is able to make contact with said credit card, or said debit card, or said identification card.

2. The belt buckle of claim 1 wherein said rear member includes a generally U-shaped interior perimeter attached thereto.

3. The belt buckle of claim 1 wherein said fastener assembly is attached to a surface of said rear member that is maximally disposed away from said front member.

4. The belt buckle of claim 1 wherein said fastener assembly includes a loop at one end, thereof and an inwardly curved hook at an opposite end, thereof.

5. The belt buckle of claim 1 wherein said front member includes a generally U-shaped exterior perimeter attached thereto, and wherein said exterior perimeter extends away from said front member toward said rear member.

6. The belt buckle of claim 1 wherein said rear member includes a generally U-shaped interior perimeter attached thereto that extends away from said rear member toward said front member, and wherein said front member includes a generally U-shaped exterior perimeter attached thereto, and wherein said exterior perimeter extends away from said front member toward said rear member, and wherein said exterior perimeter extends over said interior perimeter sufficient to cover said interior perimeter and prevent their viewing when the belt buckle is normally worn.

7. The belt buckle of claim 6 wherein said exterior perimeter overlaps an exterior perimeter of said rear member.

8. The belt buckle of claim 6 including a plurality of fasteners that secure said rear member to said front member, and wherein said exterior perimeter provides a covering over said plurality of fasteners sufficient to prevent their viewing when the belt buckle is normally worn.

9. The belt buckle of claim 1 wherein said fastener assembly includes a hollow cylindrical end that is disposed at a rear end of said fastener assembly and a cylindrical metal loop that is pivotally attached to said hollow cylindrical end, and wherein said first end of the belt is attached to said loop, and wherein said fastener assembly includes a hook that is attached to an opposite front end of said fastener assembly, and wherein said hook cooperates with one of a plurality of holes that are disposed proximate to said second end of the belt to detachably-attach said second end of the belt to said fastener assembly.

10. The belt buckle of claim 9 wherein said hook extends in a linear direction away from said fastener assembly for a predetermined distance, and wherein said hook includes, in general, a right-angle curvature at said predetermined distance, and wherein a remainder of said hook extends in a general direction toward said rear end of said fastener assembly, and wherein said hook includes, in general, an L-shape thereto.

11. The belt buckle of claim 1 including an ornamental front plate that is attached to an exterior of said front member.

12. The belt buckle of claim 1 wherein said rear member includes a notch disposed therein at an end of the belt buckle where said opening into said compartment is disposed, and wherein said notch includes a size that is sufficient to permit a portion of a finger of a user to pass through said notch and to make contact with a portion of said object that is disposed in said compartment.

* * * * *